US011724297B1

(12) United States Patent
Liang

(10) Patent No.: US 11,724,297 B1
(45) Date of Patent: Aug. 15, 2023

(54) METHOD FOR PRODUCING SEAMLESS PIPES AND EXTRUDER

(71) Applicant: Foshan Nanhai Mingsheng Machinery Manufacturing Co., Ltd, Foshan (CN)

(72) Inventor: Runming Liang, Foshan (CN)

(73) Assignee: FOSHAN NANHAI MINGSHENG MACHINERY MANUFACTURING CO. LTD, Foshan (CN)

( * ) Notice: Subject to any disclaimer, the term of this patent is extended or adjusted under 35 U.S.C. 154(b) by 0 days.

(21) Appl. No.: 18/113,410

(22) Filed: Feb. 23, 2023

(30) Foreign Application Priority Data

Jul. 8, 2022 (CN) ..... 202210800231.5

(51) Int. Cl.
*B21C 23/08* (2006.01)

(52) U.S. Cl.
CPC ..... *B21C 23/085* (2013.01)

(58) Field of Classification Search
CPC ..... B21C 23/085; B21C 23/08; B21C 23/215; B21C 23/217; B21C 23/218; B21C 23/035; B21C 35/02; B21C 35/04
USPC ..... 72/264
See application file for complete search history.

(56) References Cited

FOREIGN PATENT DOCUMENTS

| | | | | | |
|---|---|---|---|---|---|
| CN | 1857814 | A | | 11/2006 | |
| CN | 101444800 | A | | 6/2009 | |
| CN | 102303062 | A | | 1/2012 | |
| GB | 2089704 | A | * | 6/1982 | ..... B21C 23/205 |

* cited by examiner

*Primary Examiner* — Shelley M Self
*Assistant Examiner* — Teresa A Guthrie
(74) *Attorney, Agent, or Firm* — WPAT, P.C

(57) ABSTRACT

A method for producing seamless pipes and an extruder are provided, including: S1, sleeving an ingot holding cylinder on an upsetting shaft and feeding an aluminum bar; S2, moving the ingot holding cylinder backwards; S3, squeezing the aluminum bar by an extrusion plug; S4, after upsetting, moving the ingot holding cylinder and the extrusion plug back to one side away from the upsetting shaft; S5, removing the upsetting shaft and installing a mold on the mold shaft; S6, perforating the aluminum bar after upsetting by a perforating needle; S7, extruding the perforated aluminum bar by the extrusion plug. The aluminum bar after upsetting keeps the same central axis as the extruder centerline and the ingot holding cylinder. The seamless pipes extruded from the mold are uniform, thereby improving their concentricity and finished product rate.

6 Claims, 8 Drawing Sheets

METHOD FOR PRODUCING SEAMLESS PIPES AND EXTRUDER

TECHNICAL FIELD

The present invention relates to the technical field of preparation of seamless pipes, and in particular to a method for producing seamless pipes and an extruder.

BACKGROUND

The extruder is the main equipment for production of light alloy (aluminum alloy, copper alloy and magnesium alloy) pipes, bars and profiles. The principle is formation through metal plasticity and pressure, and the important characteristic is that metal ingot billets are processed into pipes, bars and profiles at one time. The formed pipe fittings have no gap, and are called seamless pipes. At present, in the production of the seamless pipes, aluminum bars are usually extruded with a plug and a mold, so that the aluminum bars are formed outwards into the seamless pipes through the mold. However, in the existing production technology, due to low concentricity of the aluminum bars and the mold, the eccentricity of finished products of the seamless pipes cannot meet the requirements, that is, there is a problem of uneven wall thickness of the seamless pipes, causing low rate of the finished products of the seamless pipes.

SUMMARY

The purpose of the present invention is to propose a method for producing seamless pipes and an extruder, to solve the technical problems that the eccentricity of an extruded seamless pipe fails to achieve the requirement and the rate of finished products is low in the prior art.

To achieve the above purpose, the present invention proposes a method for producing seamless pipes, comprising the following steps:

S1, sleeving an ingot holding cylinder on an upsetting shaft; and feeding an aluminum bar so that an extrusion plug and the upsetting shaft clamp the aluminum bar;

S2, moving the ingot holding cylinder backwards so that the aluminum bar is placed in the ingot holding cylinder;

S3, squeezing the aluminum bar by the extrusion plug to complete upsetting;

S4, after upsetting, moving the ingot holding cylinder and the extrusion plug back to one side away from the upsetting shaft;

S5, removing the upsetting shaft and locating a mold shaft on an extruder centerline; and installing a mold on the mold shaft;

S6, perforating the aluminum bar after upsetting by a perforating needle;

S7, extruding the perforated aluminum bar by the extrusion plug so that the aluminum bar is formed into a seamless pipe after passing through the mold.

Preferably, in step S6, when the perforating needle perforates the aluminum bar after upsetting, the ingot holding cylinder is subjected to an acting force in an opposite direction of movement of the perforating needle to limit the movement of the ingot holding cylinder. The ingot holding cylinder can be stationary relative to the perforating needle to ensure that the perforating needle can perforate the aluminum bar.

Preferably, step S6 comprises: S6-1, feeding a perforated baffle plate between the mold shaft and the ingot holding cylinder; clamping the perforated baffle plate by the ingot holding cylinder and the mold shaft; and locating the perforated baffle plate on the extruder centerline; S6-2, perforating the aluminum bar by the perforating needle; and S6-3, removing the perforated baffle plate after perforation. The perforating needle perforates out of part of the aluminum bar and is retained in the front cavity of the ingot holding cylinder, which greatly reduces the solid part of the front section of the seamless pipe and improves a material utilization rate.

Preferably, in step S2, after the ingot holding cylinder moves, one end of the upsetting shaft abutted against the aluminum bar is located in the ingot holding cylinder, so that one end of the aluminum bar after upsetting and the outer end surface of the ingot holding cylinder have a cavity. When the aluminum bar penetrates, the extruded aluminum material is located in the cavity, and the aluminum material in the cavity can still be squeezed into the mold during extrusion molding to participate in the formation of the seamless pipe. Thus, the material utilization rate is improved.

Preferably, the upsetting shaft and the mold shaft are installed on the same installing seat, and a driving mechanism can drive the installing seat to slide. In step S5, the driving mechanism drives the installing seat to slide, so that the upsetting shaft and the mold shaft move synchronously, and the upsetting shaft moves out and the mold shaft is located on the extruder centerline. It is convenient to control the mold shaft and the upsetting shaft to switch with each other in the process of machining, thereby improving the processing intelligence and reducing the arrangement of a driving device. Moreover, the mold shaft and the upsetting shaft are installed behind the installing seat, and the distance there between is fixed. Thus, when switching between the mold shaft and the upsetting shaft, the mold shaft and the upsetting shaft are located on the extruder centerline, thereby ensuring the accuracy.

Preferably, the method further comprises the following steps: S8, after extrusion is completed, cutting off the residual material after the extrusion by a cutter; and S9, pulling the seamless pipe outwards by a tractor so that the seamless pipe is completely separated from the mold and the mold shaft. By executing steps S8 and S9, the residual material after extrusion molding can be cut out, which is convenient for subsequent recycling. Moreover, the seamless pipe can be completely extruded in time, and no residual aluminum material exists in the mold.

Preferably, the method further comprises the following steps:

S10, disassembling the mold on the mold shaft by a manipulator;

S11, moving the extrusion plug and the ingot holding cylinder back to one side away from the mold shaft;

S12, moving the upsetting shaft onto the extruder centerline;

S13, moving the ingot holding cylinder to one side in which the upsetting shaft is located, so that the ingot holding cylinder is sleeved on the upsetting shaft. Steps S10-S13 are set for the purpose that the extruder can return to an initial state after a seamless pipe is produced, to facilitate the processing of a next seamless pipe and improve the automation, intelligence and continuity of the processing.

Preferably, in step S10, the manipulator always keeps clamping the mold after the mold is disassembled. It is convenient to install the mold directly on the mold shaft in step S5 when the next seamless pipe is processed, which improves the efficiency, and there is no need to arrange a placing rack or placing platform for placing the mold.

Preferably, in step S1, the manipulator grabs the aluminum bar and transmits the aluminum bar between the extrusion plug and the upsetting shaft; and the extrusion plug is close to the upsetting shaft, so that the extrusion plug and the upsetting shaft clamp the aluminum bar. The manipulator is used to grab and deliver the aluminum bar to ensure the safety of the feeding process and the accuracy of feeding and realize intelligent processing.

Preferably, in step S3, the diameter of the aluminum bar after upsetting is equal to the inner diameter of the ingot holding cylinder. The perforating needle is under a uniform force in perforation, to avoid the problems that the perforating needle is eccentric due to uneven force and is broken during extrusion.

In another aspect, the present invention further proposes an extruder used for executing the method for producing seamless pipes. The processing technology is subjected to equipment treatment, to achieve intelligent processing.

The method for producing seamless pipes and the extruder in the present invention have at least the following beneficial effects: the upsetting shaft and the extrusion plug are used for clamping the aluminum bar which is fed just, and upsetting the aluminum bar; the aluminum bar and the ingot holding cylinder keep the same central axis; during extrusion molding, the extrusion plug, the perforating needle, the aluminum bar and the ingot holding cylinder are coaxial with the mold; and the thickness of the seamless pipes extruded from the mold is uniform, thereby improving the concentricity of finished products of the seamless pipes and increasing the rate of finished products.

DESCRIPTION OF DRAWINGS

To more clearly describe the technical solutions in the embodiments of the present invention or in the prior art, the drawings required to be used in the description of the embodiments or the prior art will be simply presented below. Obviously, the drawings in the following description are merely some embodiments of the present invention, and for those ordinary skilled in the art, other drawings can also be obtained according to structures shown in the drawings without contributing creative labor.

Figure 1:
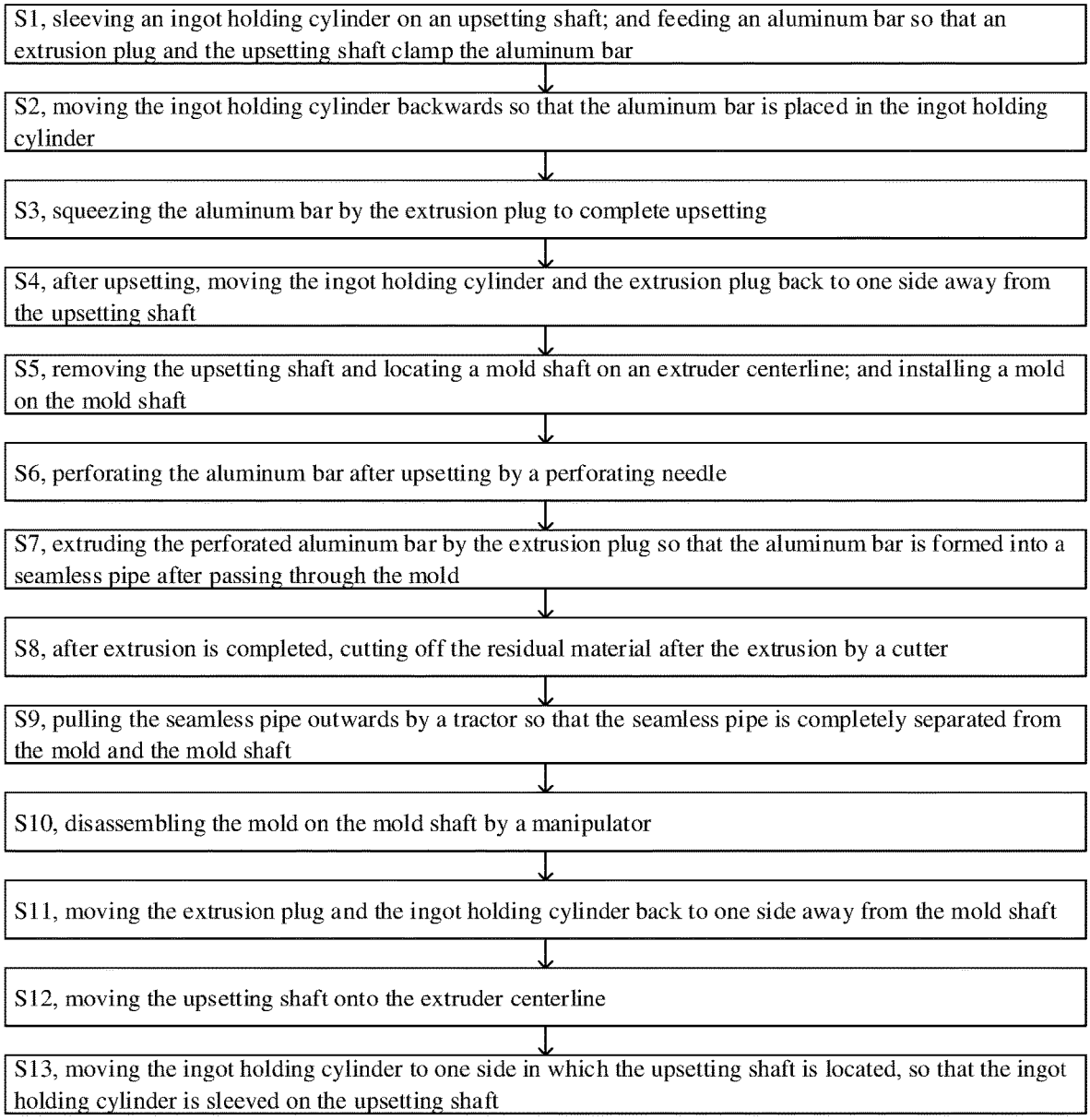
FIG. 1 is a flow chart of steps of a method for producing seamless pipes in the present invention.

In the figures: 1-ingot holding cylinder; 2-upsetting shaft; 3-aluminum bar; 4-extrusion plug; 5-mold shaft; 6-mold; 7-perforating needle; 8-seamless pipe; 9-perforated baffle plate; 10-driving mechanism; 11-cutter; 12-main oil cylinder plunger; 13-front beam; 100-extruder centerline.

Realization of the purpose, functional characteristics and advantages of the present invention will be further described in combination with the embodiments and with reference to the drawings.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

It should be noted that if the embodiments of the present invention involve directional indications (such as upper, lower, left, right, front, back and the like), the directional indications are only used to explain the relative position relationship and movement conditions of components under a specific attitude (as shown in the drawings). If the specific attitude is changed, the directional indications are changed accordingly.

In addition, if the embodiments of the present invention involve the description of "first" and "second", the description of "first" and "second" is only used for the purpose of description, rather than being understood to indicate or imply relative importance or hints the number of indicated technical features. Thus, the features limited by "first" and "second" can explicitly or impliedly comprise at least one feature. In addition, the technical solutions in the embodiments can be combined with each other, but only on the basis that the combination can be implemented by those ordinary skilled in the art. Where a combination of technical solutions is contradictory or impossible to be implemented, it shall be deemed that such combination of technical solutions does not exist and is not included within the protection scope of the present invention.

As shown in FIG. 1 to FIG. 16, a method for producing seamless pipes comprises the following steps:

S1, sleeving an ingot holding cylinder 1 on an upsetting shaft 2; and feeding an aluminum bar 3 so that an extrusion plug 4 and the upsetting shaft 2 clamp the aluminum bar 3;

S2, moving the ingot holding cylinder 1 backwards so that the aluminum bar 3 is placed in the ingot holding cylinder 1;

S3, squeezing the aluminum bar 3 by the extrusion plug 4 to complete upsetting;

S4, after upsetting, moving the ingot holding cylinder 1 and the extrusion plug 4 back to one side away from the upsetting shaft 2;

S5, removing the upsetting shaft 2 and locating a mold shaft 5 on an extruder centerline 100; and installing a mold 6 on the mold shaft 5;

S6, perforating the aluminum bar 3 after upsetting by a perforating needle 7;

S7, extruding the perforated aluminum bar 3 by the extrusion plug 4 so that the aluminum bar 3 is formed into a seamless pipe 8 after passing through the mold 6.

The ingot holding cylinder 1 is a hollow cylindrical structure, which is used to hold the aluminum bar 3. The aluminum bar 3 is a raw material for producing the seamless pipe 8. The extrusion plug 4 is used for squeezing the aluminum bar 3 during upsetting and extrusion molding of the aluminum bar 3. The upsetting shaft 2 is used for clamping the aluminum bar 3 during the feeding of the aluminum bar 3 and matching with the extrusion plug 4 for upsetting the aluminum bar 3 during upsetting. The mold shaft 5 is used for installing the mold 6, and abutting the mold 6 against the aluminum bar 3 during extrusion molding. The mold 6 is used for squeezing the aluminum bar 3 into the seamless pipe 8 during extrusion molding. The perforating needle 7 is used for perforating the aluminum bar 3 after upsetting. The extrusion plug 4 is controlled by a main oil cylinder to move, and the perforating needle 7 is controlled by a perforating oil cylinder to extend and retract.

Figure 2:
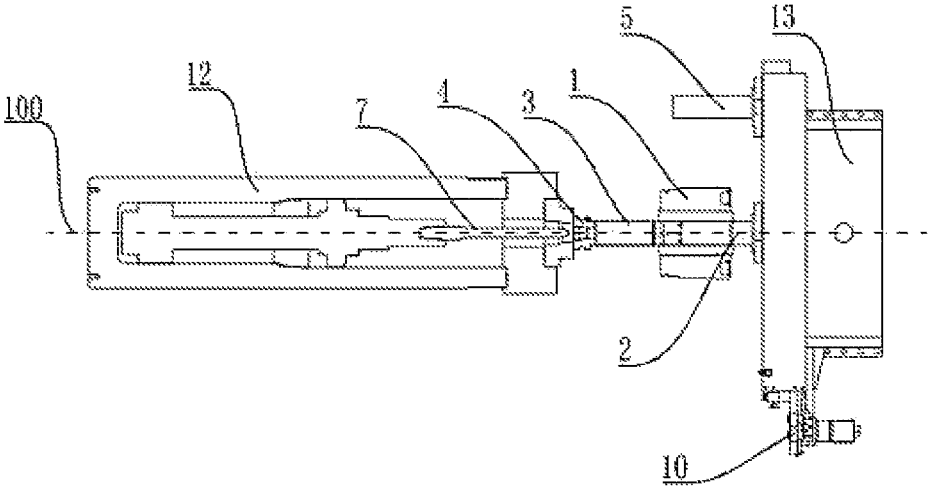
FIG. 2 is a schematic diagram of a state after step S1 is executed in the present invention.
Figure 3:
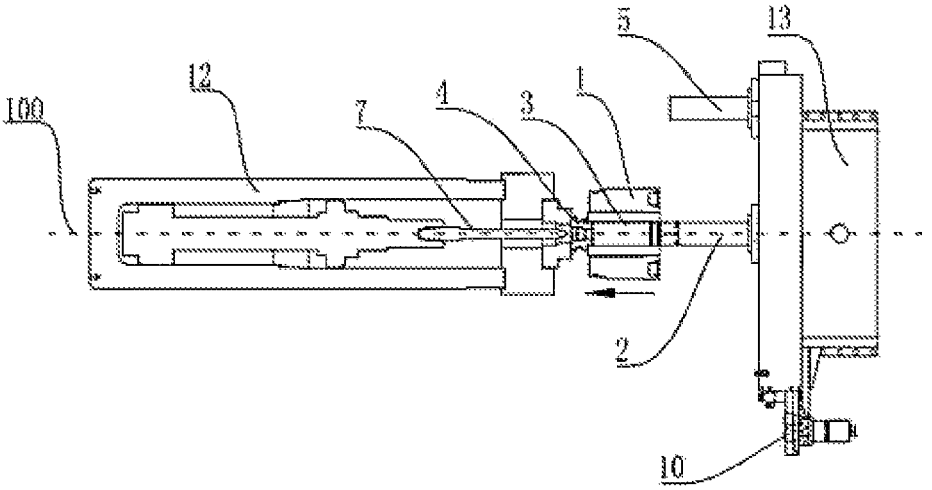
FIG. 3 is a schematic diagram of a state after step S2 and step S3 are executed in the present invention.
Figure 4:
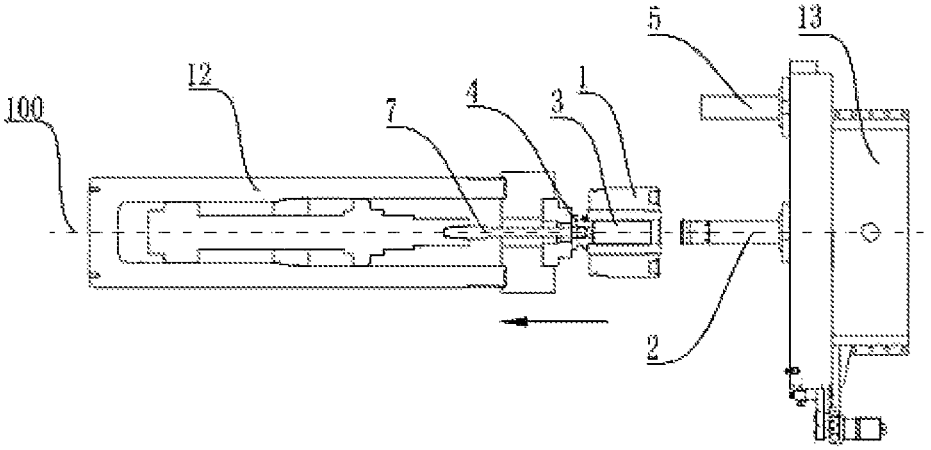
FIG. 4 is a schematic diagram of a state in execution of step S4 in the present invention.
Figure 5:
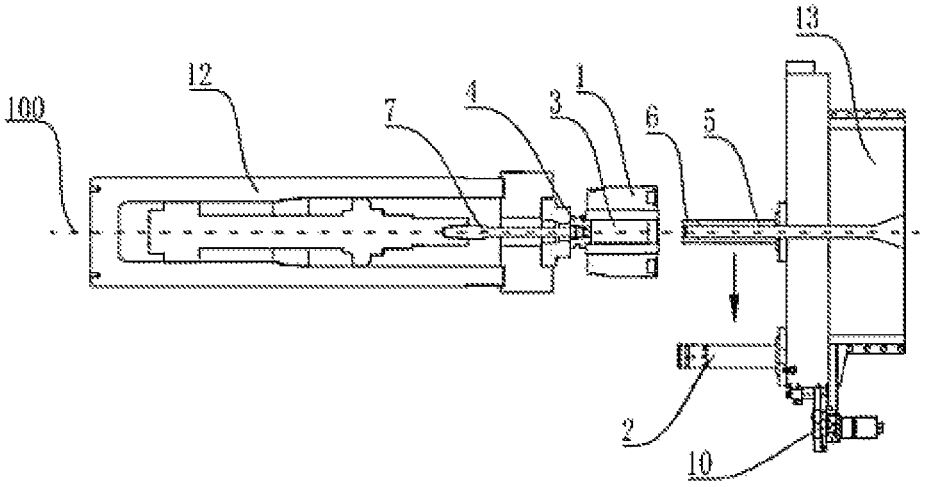
FIG. 5 is a schematic diagram of a state in execution of step S5 in the present invention.
Figure 6:
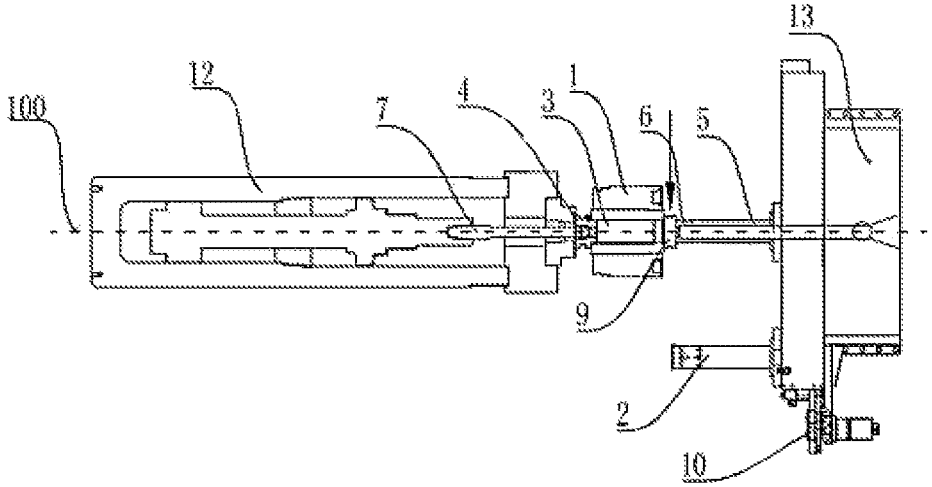
FIG. 6 is a schematic diagram of a state in execution of step S6-1 in the present invention.
Figure 7:
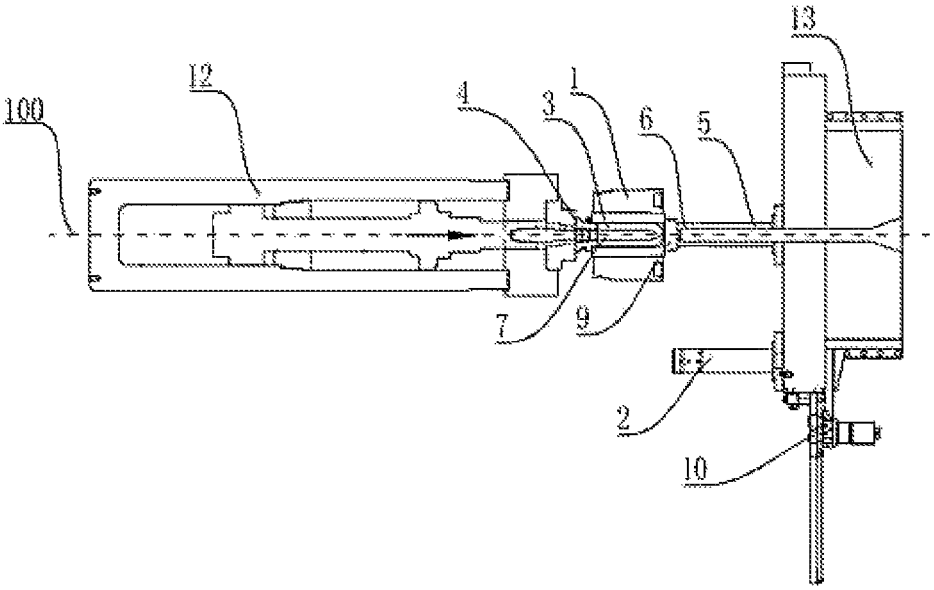
FIG. 7 is a schematic diagram of a state in execution of step S6-2 in the present invention.
Figure 8:
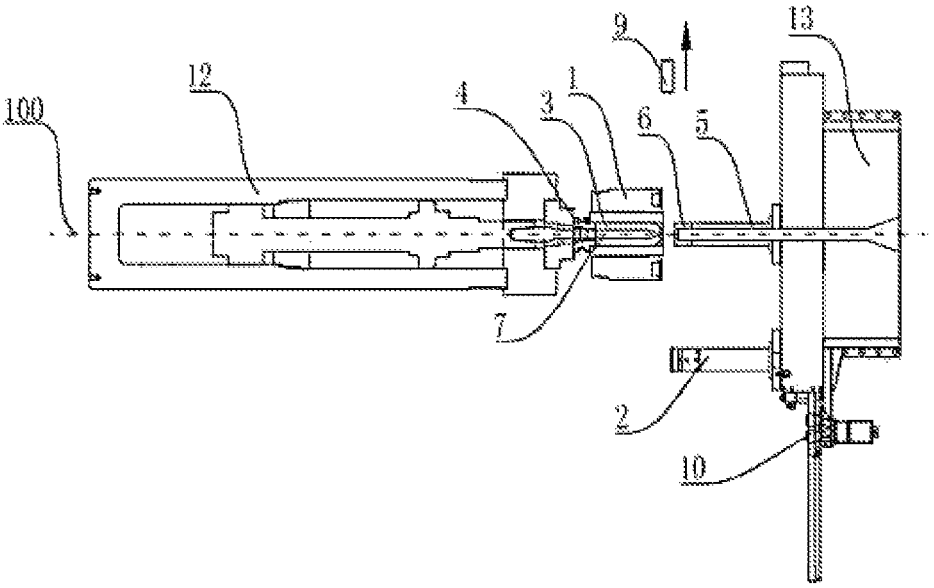
FIG. 8 is a schematic diagram of a state in execution of step S6-3 in the present invention.
Figure 9:
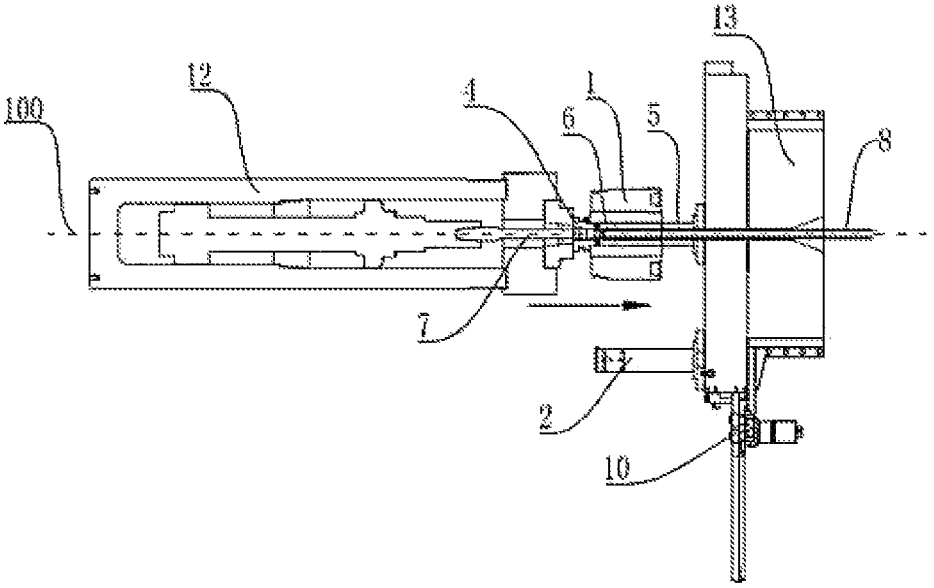
FIG. 9 is a schematic diagram of a state in execution of step S7 in the present invention.
Figure 16:
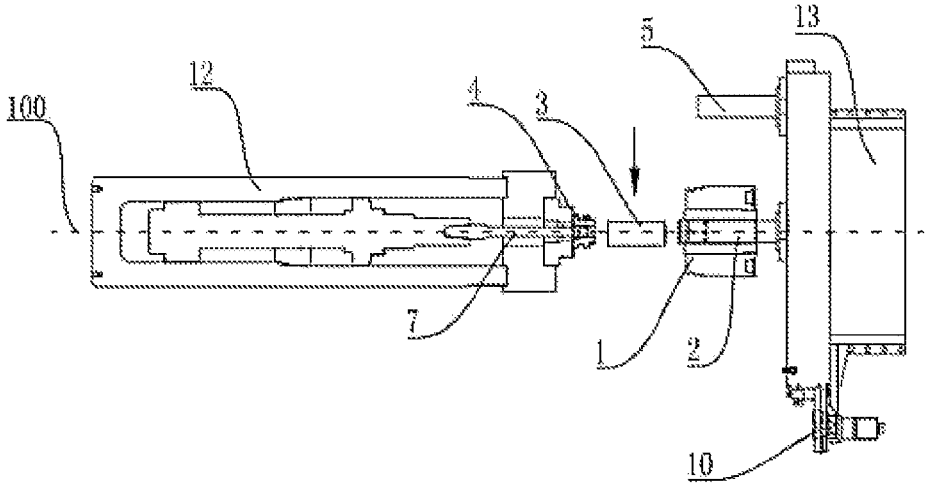
FIG. 16 is a schematic diagram of a state that an aluminum bar is fed between an extrusion plug and an upsetting shaft after step S13 is executed in the present invention.

As shown in FIG. 2, in step S1, firstly, the upsetting shaft 2 is controlled to move so that the upsetting shaft is opposite to the ingot holding cylinder 1 and the extrusion plug 4. At this time, the central axes of the upsetting shaft 2, the ingot holding cylinder 1 and the extrusion plug 4 are collinear; the central part of the ingot holding cylinder 1 is hollow, and the inner diameter is slightly greater than the maximum diameter of the upsetting shaft 2 and greater than the diameter of the aluminum bar 3; and the length of the upsetting shaft 2 is greater than the length of the ingot holding cylinder 1. The ingot holding cylinder 1 is controlled to move to one side in which the upsetting shaft 2 is located, so that the ingot holding cylinder 1 is sleeved on the upsetting shaft 2; and one end of the upsetting shaft 2 near the extrusion plug 4 extends out of the ingot holding cylinder 1. As shown in FIG. 16, the heated aluminum bar 3 is fed between the extrusion plug 4 and the upsetting shaft 2 (the aluminum bar 3 may be grabbed by the manipulator and then extends to this position); and the extrusion plug 4 is controlled to be close to the upsetting shaft 2, so that the extrusion plug 4 and the upsetting shaft 2 clamp the aluminum bar 3. As shown in FIG. 3, in step S2, the ingot holding cylinder 1 is controlled to move to one side in which the extrusion plug 4 is located, so that the ingot holding cylinder 1 is sleeved on the aluminum bar 3, i.e., the aluminum bar 3 is located inside the ingot holding cylinder 1. As shown in FIG. 2, in step S3, the upsetting shaft 2 keeps unmoved, and the extrusion plug 4 and the ingot holding cylinder 1 move slowly to one side in which the upsetting shaft 2 is located synchronously, so that the extrusion plug 4 and the upsetting shaft 2 extrude the aluminum bar 3. In the extrusion process, the aluminum bar 3 deforms, the length is decreased and the diameter is increased. This process is upsetting. After the upsetting, the diameter of the aluminum bar 3 is equal to the inner diameter of the ingot holding cylinder 1. Therefore, the central axis of the aluminum bar 3 is collinear with the central axis of the ingot holding cylinder 1. As shown in FIG. 4, in step S4, after the upsetting, the ingot holding cylinder 1 and the extrusion plug 4 move back synchronously to one side away from the upsetting shaft 2. At this time, the upsetting shaft 2 is completely separated from the ingot holding cylinder 1 and does not extend into the ingot holding cylinder 1. As shown in FIG. 5, in step S5, the upsetting shaft 2 is removed so that the upsetting shaft 2 is not coaxial with the ingot holding cylinder 1 and is located at a side of the ingot holding cylinder 1. Meanwhile, the mold shaft 5 moves onto the extruder centerline 100. At this time, the mold shaft 5, the aluminum bar 3, the ingot holding cylinder 1 and the extrusion plug 4 are coaxial. Then, the mold 6 is installed on one end of mold 6 near the aluminum bar 3. As shown in FIG. 6 to FIG. 8, in step S6, the perforating needle 7 is coaxial with the aluminum bar 3; and the perforating cylinder controls the perforating needle 7 to be close to the aluminum bar 3, and perforates the center of the aluminum bar 3. After perforation, the perforating needle 7 is inserted into the aluminum bar 3. As shown in FIG. 9, in step S7, the extrusion plug 4 and the ingot holding cylinder 1 slowly move to one side in which the mold 6 is located synchronously, so that the extrusion plug 4 extrudes the aluminum bar 3 into the mold 6 and then the seamless pipe 8 is formed outward through the mold 6. In the production method provided by the patent, the upsetting shaft 2 and the extrusion plug 4 are used for clamping the aluminum bar 3 which is fed just, and upsetting the aluminum bar 3; the aluminum bar 3 and the ingot holding cylinder 1 keep the same central axis; during extrusion molding, the aluminum bar 3 and the mold 6 are coaxial; and the thickness of the seamless pipes 8 extruded from the mold 6 is uniform, thereby improving the concentricity of finished products of the seamless pipes 8 and increasing the rate of finished products.

Further, in step S6, when the perforating needle 7 perforates the aluminum bar 3 after upsetting, the ingot holding cylinder 1 is subjected to an acting force in an opposite direction of movement of the perforating needle 7 to limit the movement of the ingot holding cylinder 1. When the perforating needle 7 perforates the aluminum bar 3, a certain force is applied to the aluminum bar 3, and the aluminum bar 3 is located inside the ingot holding cylinder 1. Therefore, the ingot holding cylinder 1 is subjected to an acting force consistent with the direction of movement of the perforating needle 7, causing that the ingot holding cylinder 1 moves during perforation and that the perforating needle 7 cannot perforate the aluminum bar 3. Therefore, during perforation, an acting force in an opposite direction of movement of the perforating needle 7 is applied to the ingot holding cylinder 1 to limit the movement of the ingot holding cylinder 1 so that the ingot holding cylinder 1 can be stationary relative to the perforating needle 7 to ensure that the perforating needle 7 can perforate the aluminum bar 3. The force applied to the ingot holding cylinder 1 can pull or withstand the ingot holding cylinder 1 by controlling the oil cylinder, etc., or other limiting structures can be adopted to limit the movement of the ingot holding cylinder 1.

Further, step S6 comprises: S6-1, feeding a perforated baffle plate 9 between the mold shaft 5 and the ingot holding cylinder 1; clamping the perforated baffle plate 9 by the ingot holding cylinder 1 and the mold shaft 5; and locating the perforated baffle plate 9 on the extruder centerline 100; S6-2, perforating the aluminum bar 3 by the perforating needle 7; S6-3, removing the perforated baffle plate 9 after perforation.

Step S6 is a step of perforating the aluminum bar 3 after upsetting, comprising step S6-1, step S6-2 and step S6-3. As shown in FIG. 6, in step S6-1, the perforated baffle plate 9 moves onto the extruder centerline 100 and is located between the ingot holding cylinder 1 and the mold shaft 5; and the width of the perforated baffle plate 9 is greater than the inner diameter of the ingot holding cylinder 1 so that the perforated baffle plate 9 can completely cover an opening at one end of the ingot holding cylinder 1. The extrusion plug 4 and the ingot holding cylinder 1 move close to the mold shaft 5 so that the ingot holding cylinder 1 and the mold shaft 5 clamp the perforated baffle plate 9. As shown in FIG. 7, in step S6-2, the perforating cylinder controls the perforating needle 7 to extend and perforate at the center of the aluminum bar 3 along the axial direction; and the perforated and extruded aluminum material is located between the aluminum bar 3 and the perforated baffle plate 9. As shown in FIG. 8, in step S6-3, the perforated baffle plate 9 is removed after perforation of the aluminum bar 3. In the prior art, when the aluminum bar 3 is perforated, the mold 6 is usually used to withstand the aluminum bar 3, which will cause that the perforated and extruded aluminum material is squeezed into the mold 6, thereby resulting in a long solid part of the front end of the extruded seamless pipe 8. In the present embodiment, when the aluminum bar 3 is perforated, the perforated baffle plate 9 withstands one end of the ingot holding cylinder 1 and blocks one of the openings of the ingot holding cylinder 1. The perforated baffle plate 9 is used to limit the ingot holding cylinder 1 during perforation of the aluminum bar 3 to prevent the ingot holding cylinder 1 from approaching the mold 6; and the perforated and extruded aluminum material is retained in a front cavity of the ingot holding cylinder. Therefore, the solid part of the front section of the seamless pipe 8 is greatly reduced and a material utilization rate is improved.

Further, in step S2, after the ingot holding cylinder 1 moves, one end of the upsetting shaft 2 abutted against the aluminum bar 3 is located in the ingot holding cylinder 1, so that one end of the aluminum bar 3 after upsetting and the outer end surface of the ingot holding cylinder 1 have a cavity. After the ingot holding cylinder 1 is sleeved on the aluminum bar 3, there is a certain distance between one end of the aluminum bar 3 near the upsetting shaft 2 and the outer end surface of the ingot holding cylinder 1 (i.e., the two are not flush). In this arrangement, the extruded aluminum material can be located in the cavity when the aluminum bar 3 passes. During extrusion molding, the aluminum material in the cavity can still be squeezed into the mold 6 to participate in the formation of the seamless pipe 8. Thus, the material utilization rate is improved.

Further, the upsetting shaft 2 and the mold shaft 5 are installed on the same installing seat, and a driving mechanism 10 can drive the installing seat to slide. In step S5, the driving mechanism 10 drives the installing seat to slide, so that the upsetting shaft 2 and the mold shaft 5 move synchronously, and the upsetting shaft 2 moves out and the mold shaft 5 is located on the extruder centerline 100.

Specifically, the installing seat is slidably arranged on a front beam 13; the driving mechanism 10 is also installed on the front beam; and the driving mechanism 10 is used to drive the installing seat to slide relative to the front beam 13. The mold shaft 5 and the upsetting shaft 2 are simultaneously installed on the installing seat. When the installing seat slides, the mold shaft 5 and the upsetting shaft 2 are driven to move synchronously. The mold shaft 5 and the upsetting shaft 2 are parallel to each other and spaced by a certain distance. The distance between the mold shaft 5 and the upsetting shaft 2 is larger than the radius of the ingot holding cylinder 1. The upsetting shaft 2 and the mold shaft 5 are arranged in sequence along the movement direction of the installing seat and are at the same horizontal height. One end of the mold shaft 5 is fixed to the installing seat and the other end is used to install the mold 6. The driving mechanism 10 can be specifically a combined mechanism of a motor, a gear and a rack, and can also be a ball screw, a hydraulic cylinder, a conveyor belt and other devices, as long as the requirement of driving the installing seat to move back and forth can be satisfied. The mold shaft 5 and the upsetting shaft 2 are fixed to the same installing seat to realize synchronous movement of the two, which is convenient to control the switch between the mold shaft 5 and the upsetting shaft 2 in the machining process, improve the processing intelligence and reduce the arrangement of a driving device. Moreover, the mold shaft 5 and the upsetting shaft 2 are installed behind the installing seat, and the distance therebetween is fixed. Thus, when switching between the mold shaft and the upsetting shaft, the mold shaft and the upsetting shaft are located on the extruder centerline 100, thereby ensuring the accuracy.

Further, the method further comprises the following steps: S8, after extrusion is completed, cutting off the residual material after the extrusion by a cutter 11; and S9, pulling the seamless pipe 8 outwards by a tractor so that the seamless pipe 8 is completely separated from the mold 6 and the mold shaft 5.

Figure 10:
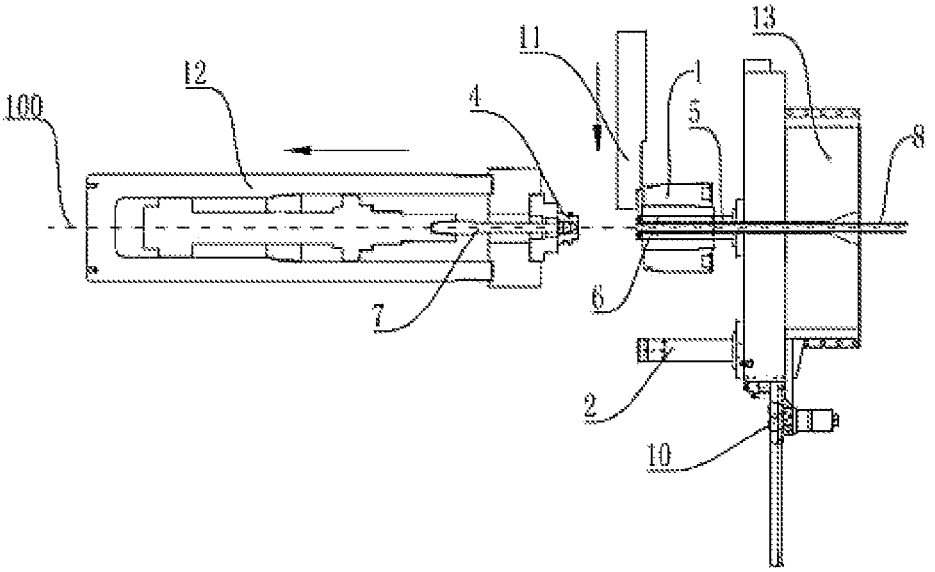
FIG. 10 is a schematic diagram of a state before step S8 is executed in the present invention.
Figure 11:
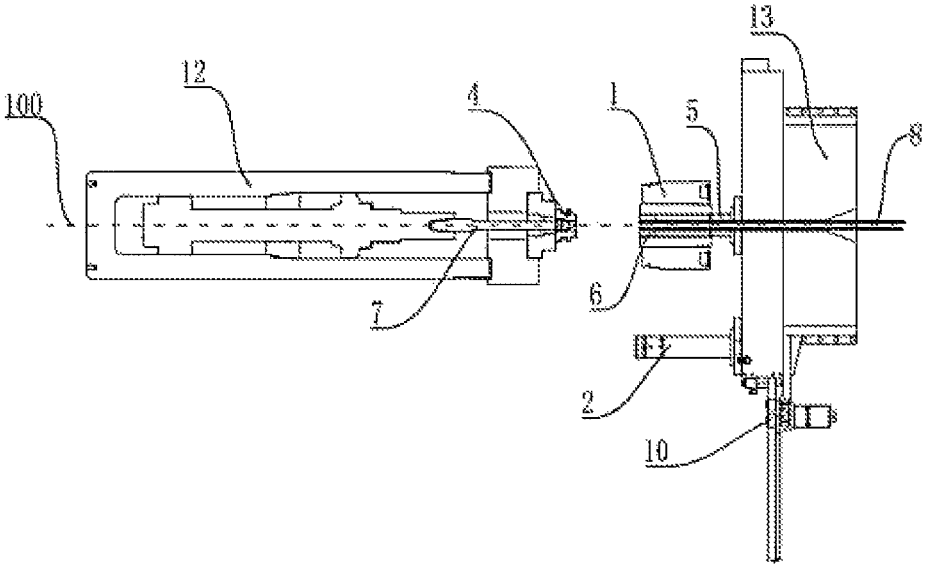
FIG. 11 is a schematic diagram of a state after step S8 is executed in the present invention.

As shown in FIG. 10 and FIG. 11, in step S8, after extrusion is completed, the aluminum bar 3 will have the remains of a small part of residual aluminum material. After extrusion, the extrusion plug 4 is controlled to move back (away from the ingot holding cylinder 1) at first. At this time, one end of the mold 6 is flush with the outer end surface of the ingot holding cylinder 1, and the residual material is located at the outer side of the mold 6 and the ingot holding cylinder 1. The cutter 11 is attached to the outer end surface of the ingot holding cylinder 1. The cutter 11 is controlled to approach the residual material from top to bottom or from both sides, and then the residual material is cut off. In step S9, after the extrusion is completed, because the aluminum bar 3 is not extruded by the extrusion plug 4, the seamless pipe 8 needs to be pulled out by an external force so that the seamless pipe 8 is completely separated from the mold 6 and the mold shaft 5, and is specifically pulled out by a tractor. In the forming process of the seamless pipe 8, the tractor can also assist the extrusion molding of the seamless pipe 8 by pull-out. By executing steps S8 and S9, the residual material after extrusion molding can be cut out, which is convenient for subsequent recycling. Moreover, the seamless pipe 8 can be completely extruded in time, and no residual aluminum material exists in the mold 6.

Further, the method further comprises the following steps: S10, disassembling the mold 6 on the mold shaft 5 by a manipulator; S11, moving the extrusion plug 4 and the ingot holding cylinder 1 back to one side away from the mold shaft 5; S12, moving the upsetting shaft 2 onto the extruder centerline 100; S13, moving the ingot holding cylinder 1 to one side in which the upsetting shaft 2 is located, so that the ingot holding cylinder 1 is sleeved on the upsetting shaft 2.

Figure 12:
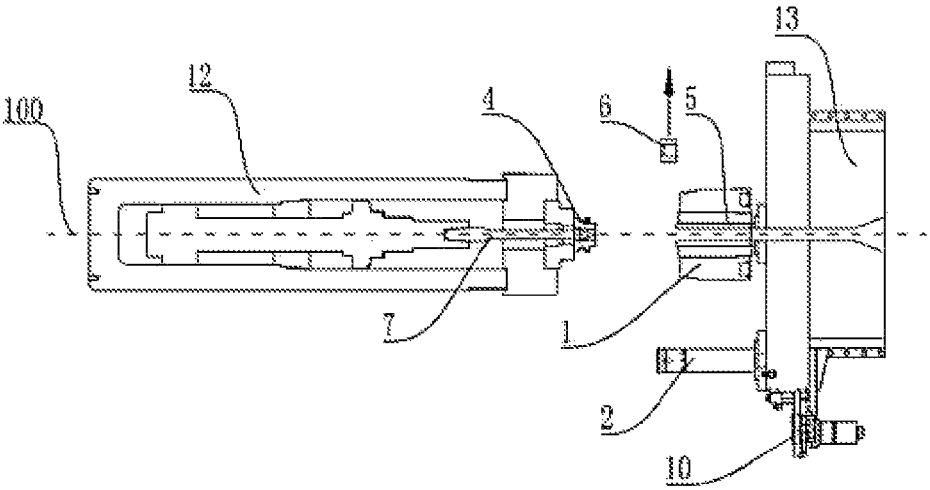
FIG. 12 is a schematic diagram of a state after step S9 and step S10 are executed in the present invention.
Figure 13:
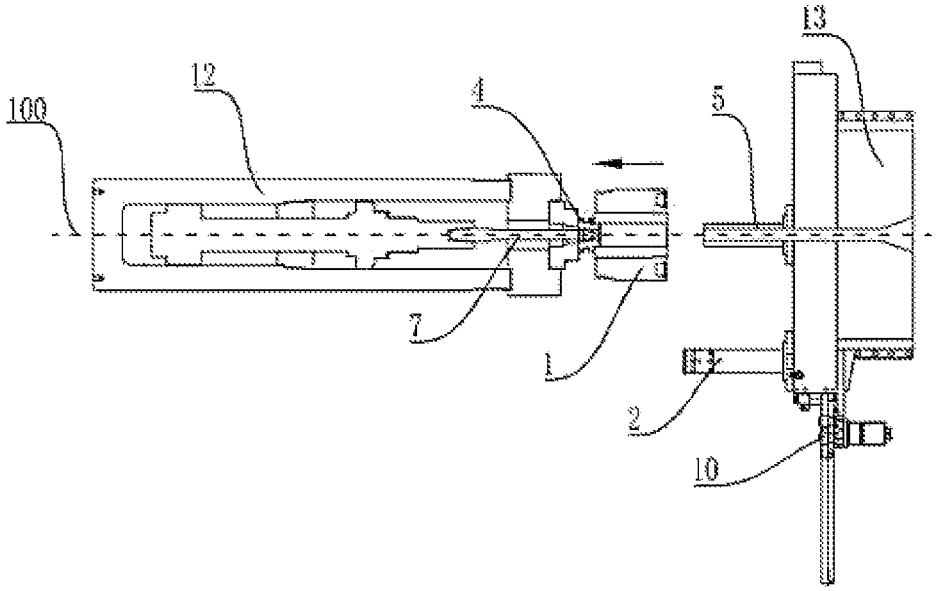
FIG. 13 is a schematic diagram of a state in execution of step S11 in the present invention.
Figure 14:
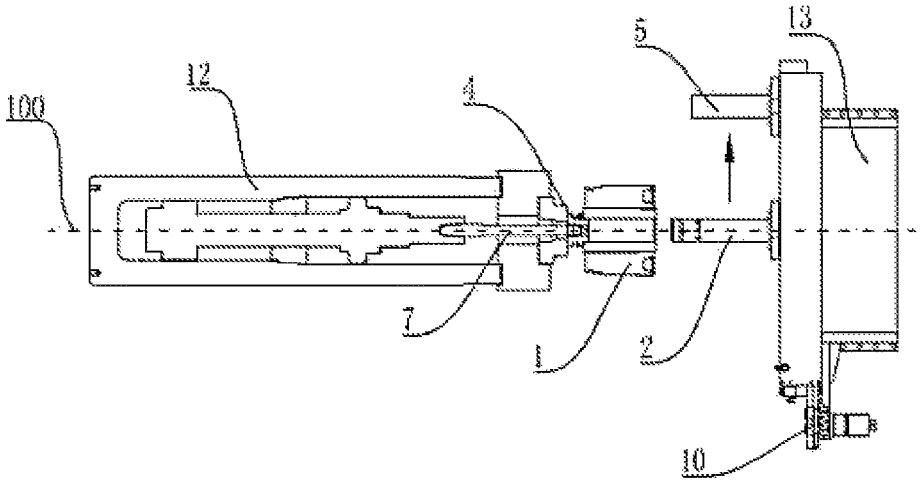
FIG. 14 is a schematic diagram of a state in execution of step S12 in the present invention.
Figure 15:
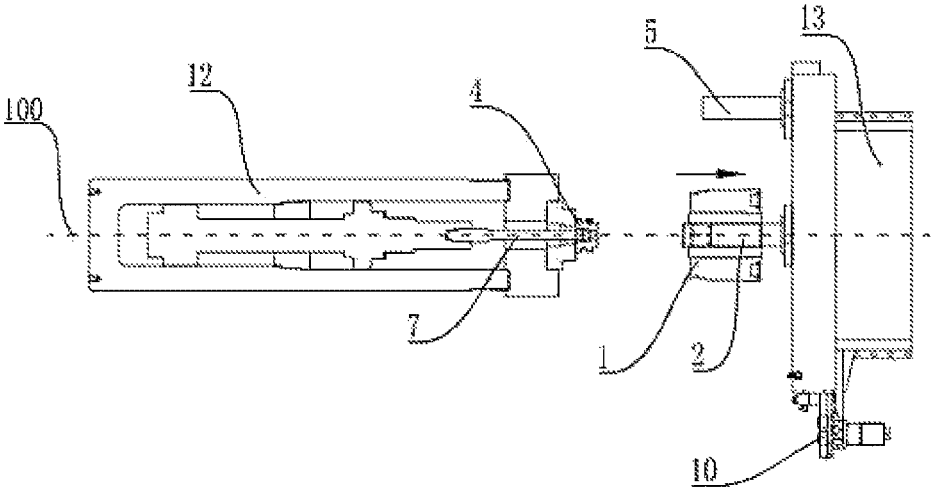
FIG. 15 is a schematic diagram of a state in execution of step S13 in the present invention.

As shown in FIG. 12, in step S10, the manipulator is used for disassembling the mold 6 from the mold shaft 5. As shown in FIG. 13, in step S11, the extrusion plug 4 and the ingot holding cylinder 1 move back synchronously to one side away from the mold shaft 5; and the distance of moving back ensures that the upsetting shaft 2 may not impact the ingot holding cylinder 1 when moving. As shown in FIG. 14, in step S12, the driving mechanism 10 controls the installing seat to slide, so that the upsetting shaft 2 and the mold shaft 5 move synchronously, and the upsetting shaft 2 moves onto the extruder centerline 100. At this time, the extrusion plug 4, the ingot holding cylinder 1 and the upsetting shaft 2 keep the same central axis. As shown in FIG. 15, in step S13, the ingot holding cylinder 1 moves to one side in which the upsetting shaft 2 is located, and moves to a state in which the ingot holding cylinder 1 is sleeved on the upsetting shaft 2. One end of the upsetting shaft 2 near the extrusion plug 4 extends out of the ingot holding cylinder 1. That is, after step S13 is completed, a state at the beginning of step S1 is returned, so as to enter a readiness state for processing the next seamless pipe 8. FIG. 16 shows a schematic diagram of a state in which the aluminum bar 3 is fed between the extrusion plug 4 and the upsetting shaft 2, i.e., shows "sleeving an ingot holding cylinder on an upsetting shaft 2; and feeding an aluminum bar 3" in step S1. Steps S1 to S13 are repeated to continuously process the seamless pipes 8. Steps S10-S13 are set for the purpose that the extruder can return to an initial state after a seamless pipe 8 is produced, to facilitate the processing of a next seamless pipe 8 and improve the automation, intelligence and continuity of the processing.

Further, in step S10, the manipulator always keeps clamping the mold 6 after the mold 6 is disassembled. During the whole processing, the feeding of the aluminum bar 3 needs a manipulator, and the installation and disassembly of the mold 6 also need a manipulator. Specifically, the manipulators used by two actions are different, that is, one manipulator is specifically used for feeding the aluminum bar 3, and the other manipulator is used for installing and disassembling the mold 6. Therefore, in step S10, the manipulator always keeps clamping after the mold 6 is disassembled from the mold shaft 5, which is convenient to install the mold 6 directly on the mold shaft 5 in step S5 when the next seamless pipe 8 is processed, to improve the efficiency, and there is no need to arrange a placing rack or placing platform for placing the mold 6. In practical operation, the seamless pipes 8 are generally processed in a batch, so the frequency for replacement of the mold 6 is less. When the mold 6 needs to be replaced, the personnel can take away the mold 6 from the manipulator, and then put another mold 6, or the manipulator can put down the mold 6, and then grab another mold 6.

Further, in step S1, the manipulator grabs the aluminum bar 3 and transmits the aluminum bar between the extrusion plug 4 and the upsetting shaft 2; and the extrusion plug 4 is close to the upsetting shaft 2, so that the extrusion plug 4 and the upsetting shaft 2 clamp the aluminum bar 3. As described previously, the manipulator is used for grabbing and transmission in feeding of the aluminum bar 3. When the manipulator transmits the aluminum bar 3 between the extrusion plug 4 and the upsetting shaft 2, the extrusion plug 4, the upsetting shaft 2 and the aluminum bar 3 keep the same central axis. The extrusion plug 4 moves, so that the extrusion plug 4 and the upsetting shaft 2 clamp the aluminum bar 3. Because the aluminum bar 3 is heated before feeding and the weight of the aluminum bar 3 is heavy, the manipulator is used to grab and deliver the aluminum bar 3 to ensure the safety of the feeding process and the accuracy of feeding and realize intelligent processing.

Further, in step S3, the diameter of the aluminum bar 3 after upsetting is equal to the inner diameter of the ingot holding cylinder 1. The diameter of the aluminum bar 3 which is fed just is less than the inner diameter of the ingot holding cylinder 1. When the aluminum bar 3 is located in the ingot holding cylinder 1, the aluminum bar and the ingot holding cylinder are not have the same central axis. In case of direct perforation and extrusion molding, it is easy to lead to a series of problems of extrusion eccentricity, fracture of the perforating needle 7 during extrusion, etc. Therefore, the extrusion plug 4 and the upsetting shaft 2 are used for upsetting the aluminum bar 3. Thus, the diameter of the aluminum bar 3 is equal to the inner diameter of the ingot holding cylinder 1, and at this time, the aluminum bar and the ingot holding cylinder keep the same central axis, to avoid the problems that the perforating needle 7 is eccentric due to uneven force and is broken during extrusion.

In another aspect, an extruder is used for executing the method for producing seamless pipes. The extruder is used for executing the method for producing seamless pipes, so that the processing technology is subjected to equipment treatment, to achieve intelligent processing. The extruder has the technical effects of the method for producing seamless pipes, and will not be repeated here.

The above only describes preferred embodiments of the present invention, but is not intended to limit the patent scope of the present invention. Under the invention conception of the present invention, any equivalent structure transformation made by using contents of the description and drawings of the present invention, or directly or indirectly used in other relevant technical fields shall be similarly contained within the protection scope of patent of the present invention.

The invention claimed is:

1. A method for producing seamless pipes, comprising the following steps:

S1, sleeving an ingot holding cylinder on an upsetting shaft; and feeding an aluminum bar so that an extrusion plug and the upsetting shaft clamp the aluminum bar;

S2, moving the ingot holding cylinder backwards so that the aluminum bar is placed in the ingot holding cylinder;

S3, squeezing the aluminum bar by the extrusion plug to complete upsetting;

S4, after upsetting, moving the ingot holding cylinder and the extrusion plug back to one side away from the upsetting shaft;

S5, removing the upsetting shaft and locating a mold shaft on an extruder centerline; and installing a mold on the mold shaft;

S6, perforating the aluminum bar after upsetting by a perforating needle, wherein step S6 comprises:

S6-1, feeding a perforated baffle plate between the mold shaft and the ingot holding cylinder; clamping the perforated baffle plate by the ingot holding cylinder and the mold shaft; and locating the perforated baffle plate on the extruder centerline;

S6-2, perforating the aluminum bar by the perforating needle; and

S6-3, removing the perforated baffle plate after perforation;

S7, extruding the perforated aluminum bar by the extrusion plug so that the aluminum bar is formed into a seamless pipe after passing through the mold;

wherein in step S2, after the ingot holding cylinder moves, one end of the upsetting shaft abutted against the aluminum bar is located in the ingot holding cylinder, so that one end of the aluminum bar after upsetting and the outer end surface of the ingot holding cylinder have a cavity; and wherein in step S3, the diameter of the aluminum bar after upsetting is equal to the inner diameter of the ingot holding cylinder;

wherein the method for producing seamless pipes further comprises the following steps:

S8, after extrusion is completed, cutting off the residual material after the extrusion by a cutter;

S9, pulling the seamless pipe outwards by a tractor so that the seamless pipe is completely separated from the mold and the mold shaft;

S10, disassembling the mold on the mold shaft by a manipulator;

S11, moving the extrusion plug and the ingot holding cylinder back to one side away from the mold shaft;

S12, moving the upsetting shaft onto the extruder centerline; and

S13, moving the ingot holding cylinder to one side in which the upsetting shaft is located, so that the ingot holding cylinder is sleeved on the upsetting shaft.

2. The method for producing seamless pipes according to claim 1, wherein in step S6, when the perforating needle perforates the aluminum bar after upsetting, the ingot holding cylinder is subjected to an acting force in an opposite direction of movement of the perforating needle to limit the movement of the ingot holding cylinder.

3. The method for producing seamless pipes according to claim 1, wherein the upsetting shaft and the mold shaft are installed on the same installing seat, and a driving mechanism can drive the installing seat to slide; in step S5, the driving mechanism drives the installing seat to slide, so that the upsetting shaft and the mold shaft move synchronously, and the upsetting shaft moves out and the mold shaft is located on the extruder centerline.

4. The method for producing seamless pipes according to claim 1, wherein in step S10, the manipulator always keeps clamping the mold after the mold is disassembled.

5. The method for producing seamless pipes according to claim 1, wherein in step S1, the manipulator grabs the aluminum bar and transmits the aluminum bar between the extrusion plug and the upsetting shaft; and the extrusion plug is close to the upsetting shaft, so that the extrusion plug and the upsetting shaft clamp the aluminum bar.

6. An extruder, used for executing the method for producing seamless pipes in claim 1.

* * * * *